US008378204B2

(12) United States Patent
Arayama

(10) Patent No.: US 8,378,204 B2
(45) Date of Patent: Feb. 19, 2013

(54) PEDAL DEVICE FOR ELECTRONIC KEYBOARD INSTRUMENT

(75) Inventor: Yoshihiko Arayama, Shizuoka-ken (JP)

(73) Assignee: Roland Corporation, Shizuoka-Ken (JP)

( * ) Notice: Subject to any disclaimer, the term of this patent is extended or adjusted under 35 U.S.C. 154(b) by 2 days.

(21) Appl. No.: 12/978,311

(22) Filed: Dec. 23, 2010

(65) Prior Publication Data

US 2011/0214557 A1 Sep. 8, 2011

(30) Foreign Application Priority Data

Mar. 3, 2010 (JP) ..... 2010-046624

(51) Int. Cl.
*G10H 1/32* (2006.01)
*G10H 3/00* (2006.01)

(52) U.S. Cl. ..... 84/746; 84/225; 84/229; 84/718; 84/721; 84/743

(58) Field of Classification Search ..... 84/225, 84/229, 721, 746
See application file for complete search history.

(56) References Cited

U.S. PATENT DOCUMENTS

| | | | | |
|---|---|---|---|---|
| 4,744,279 | A | 5/1988 | Livingston | |
| 2006/0096448 | A1 | 5/2006 | Yoshino et al. | |
| 2009/0235803 | A1 * | 9/2009 | Iwamoto et al. | 84/229 |
| 2009/0314156 | A1 | 12/2009 | Komatsu | |

FOREIGN PATENT DOCUMENTS

| | | |
|---|---|---|
| JP | 58-86694 | 6/1983 |
| JP | 09-097075 | 8/1997 |
| JP | 2004334008 | 11/2004 |

OTHER PUBLICATIONS

Abstract of Japanese Publcation No. JP2004334008 published Nov. 25, 2004 by Yamaha Corp.
English translation of Japanese Publication No. JP2004334008 published Nov. 25, 2004, by Yamaha Corp.
English machine translation for JP09-097075 filed Aug. 4, 1997 for Roland Corp.
Extended European Search Report dated Dec. 14, 2011 for Application No. 11153681.9-2225/2372694.

* cited by examiner

*Primary Examiner* — Marlo Fletcher
(74) *Attorney, Agent, or Firm* — David W. Victor; Konrad Raynes Davda & Victor LLP

(57) ABSTRACT

A pedal device for an electronic keyboard apparatus adds sound effects to musical notes generated by the electronic keyboard apparatus in response to an operator depressing the pedal device. A first reaction force application device is configured to apply a first reaction force countering a depression of the pedal by the operator from an initial state to a specified state to produce a first reaction force, wherein the first reaction force increases as the pedal is depressed from the initial state to the specified state. A second reaction force application device that is configured to apply a second reaction force countering a depression of the pedal by the operator after the specified state, wherein after the specified state the first reaction force and the second reaction force are applied to the pedal.

17 Claims, 9 Drawing Sheets

PEDAL DEVICE FOR ELECTRONIC KEYBOARD INSTRUMENT

CROSS-REFERENCE TO RELATED FOREIGN APPLICATION

This application is a non-provisional application that claims priority benefits under Title 35, United States Code, Section 119(a)-(d) from Japanese Patent Application entitled "PEDAL SYSTEM FOR ELECTRONIC KEYBOARD INSTRUMENTS" by Yoshihiko ARAYAMA, having Japanese Patent Application Serial No. 2010-046624, filed on Mar. 3, 2010, which Japanese Patent Application is incorporated herein by reference in its entirety.

BACKGROUND OF THE INVENTION

1. Field of the Invention

The present invention relates to a pedal device for an electronic keyboard instrument.

2. Description of the Related Art

In recent years, electronic keyboard apparatuses such as electronic pianos and the like that spuriously reproduce the tone colors, the maneuverability, the external appearance and the like of acoustic pianos have gained popularity. As a pedal device used for an electronic keyboard apparatus of the type described above, Japanese Laid-open Patent Application, Publication No. JP2004-334008, describes a pedal device that is equipped with a first pedal lever that is operated through depression by the performer, a second pedal lever that moves together with the first pedal lever when the first pedal lever is depressed by an amount greater than the reference amount, and a first spring and a second spring that give reaction forces countering the depression operation of the first pedal lever to the first pedal lever and the second pedal level, respectively. According to the pedal device, the operation load to the first pedal lever is changed in a stepwise fashion according to the depression amount by the first spring and the second spring, whereby a feeling of operation similar to that given by the damper pedal of an acoustic piano can be realized.

However, while the pedal device described in Japanese Patent Application, Publication No. JP2004-334008 described above can realize a feeling of operation similar to that given by the damper pedal of an acoustic piano, it entails problems, such as, a larger number of components and a more complex structure as it is equipped with two pedal levers, i.e., the first pedal lever and the second pedal lever, which lead to an increased size of the device.

SUMMARY

A pedal device used by a performer of an electronic keyboard apparatus includes a pedal that is moved in response to a depression operation from the performer; a chassis that rotationally supports the pedal according to the depression operation to move the pedal downwardly about a supporting position supported by the chassis; a first reaction force application device that applies a first reaction force countering the depression operation of the pedal to the pedal; and a second reaction force application device that is pre-compressed in a state in which the amount of depression of the pedal does not reach a specified amount, and is compressed in association with the depression operation of the pedal when the amount of depression of the pedal exceeds the specified amount, wherein the second reaction force application device applies a second reaction force with an elastic force countering the depression operation to the pedal. The first reaction force application device is located between the supporting position of the pedal and the operation position, and wherein the first reaction force is applied to the pedal at a position between the supporting position and the operation position. The second reaction force application device is located between a position of the first reaction force application device and the operation position, and wherein the second reaction force application device applies the second reaction force to the pedal at a position between a position of the first reaction force application device and the operation position.

BRIEF DESCRIPTION OF THE DRAWINGS

FIGS. 5*a* and 5*b* show cross-sectional views of the pedal device of an electronic keyboard apparatus taken along a line II-II of FIG. 1, wherein FIG. 5*a* shows an initial state of the first pedal, and FIG. 5*b* shows a depressed state of the first pedal.

FIGS. 6*a*, 6*b*, 6*c* illustrate cross-sectional views of the pedal device of an electronic keyboard apparatus taken along a line III-III of FIG. 1, wherein FIG. 6*a* illustrates an initial state of the third pedal, FIG. 6*b* illustrates a specified state of the third pedal, and FIG. 6*c* illustrates a depressed state of the third pedal.

DETAILED DESCRIPTION

Figure 1:
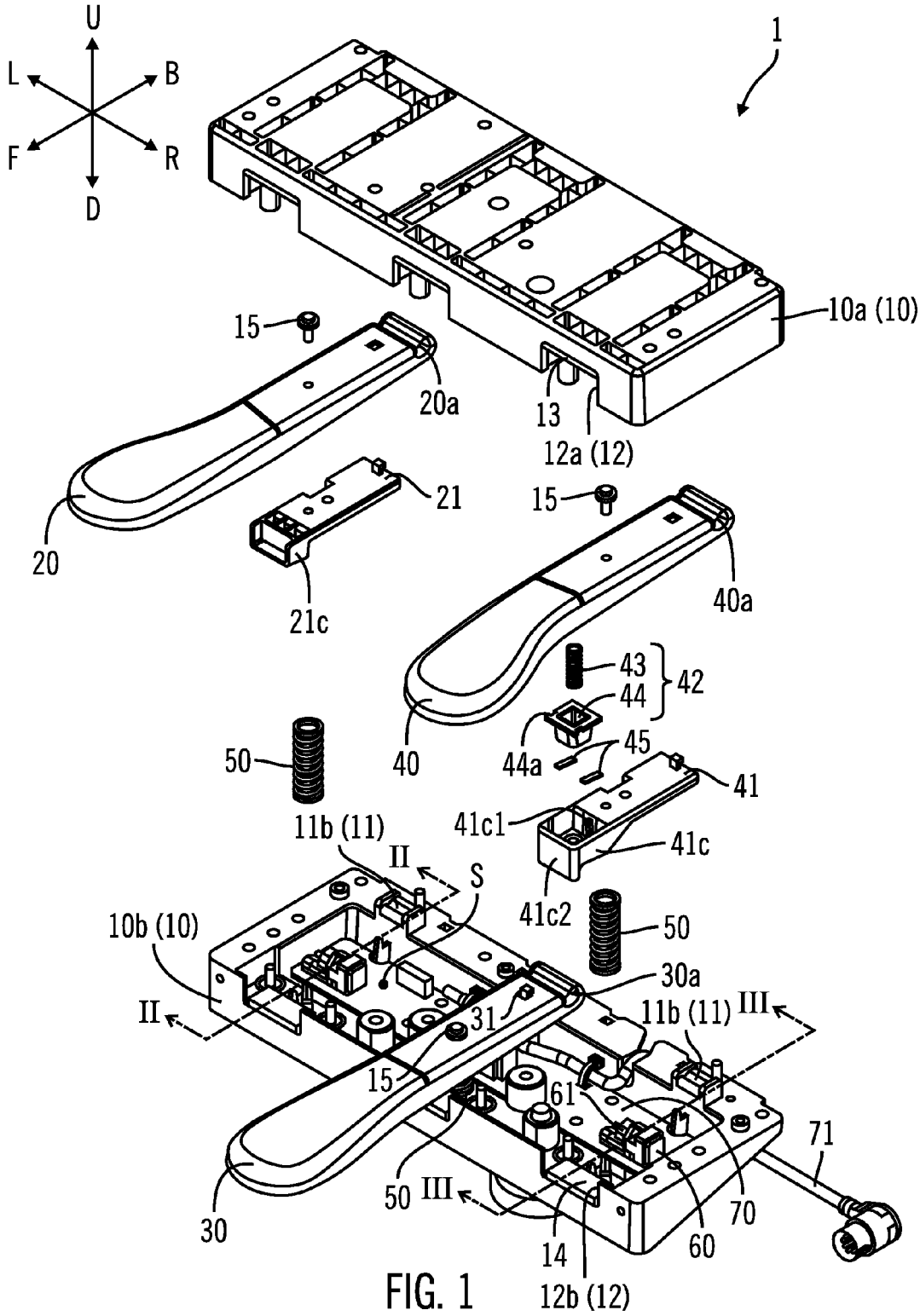
FIG. 1 illustrates an exploded perspective view of a pedal device of an electronic keyboard apparatus in accordance with an embodiment of the invention.

The described embodiments provide a pedal device of an electronic keyboard apparatus, capable of reducing the size thereof, while realizing a feeling of operation similar to that of the damper pedal of an acoustic piano.

A pedal device of an electronic keyboard apparatus is equipped with a first reaction force application device that gives a first reaction force countering a depression operation to the pedal, and a second reaction force application device that is compressed in association with the depression operation of the pedal when the amount of depression exceeds a specified amount, and applies a second reaction force with an elastic force countering the depression operation to the pedal, such that the operation load of the pedal can be changed in a stepwise fashion according to the amount of depression. Therefore, it is possible to realize a feeling of operation similar to that given by the damper pedal of an acoustic piano.

Further, the first reaction force application device is provided between a supporting position of the pedal supported by a chassis and an operation position of the pedal that is operated through depression by the performer. The first reaction force application device applies the first reaction force to the pedal at a location between the supporting position and the operation position. The second reaction force application device is provided between a position of the first reaction force application device and the operation position of the pedal. Further, the second reaction force application device applies the second reaction force to the pedal at a location between the arranged position of the first reaction force application device and the operation position. This is effective in making the second reaction force application device smaller in size and making the pedal device smaller in size.

In other words, the elastic force of the second reaction force application device that is necessary for applying the second reaction force to the pedal may become smaller, based on the principle of leverage, when the second reaction force application device is located farther from the supporting position of the pedal and closer to the operation position, and may become greater as it is located farther from the operation position of the pedal and closer to the supporting position. For this reason, if the second reaction force is applied to the pedal at a position between the arranged position of the first reaction force application device and the supporting position, then the second reaction force application device needs a greater elastic force, which, as a result, causes the second reaction force application device to become larger in size. In other words, when the second reaction force application device is to be formed from a coil spring, its coil wire needs to be thicker or the coil outer diameter needs to be larger.

In contrast, by applying the second reaction force to the pedal at a position between the arranged position of the first reaction force application device and the operation position, then the second reaction force application device has a position set farther from the supporting position of the pedal and closer to the operation position, which allows the elastic force required for the second reaction force application device to be made smaller. By this, the second reaction force application device can be made smaller in size, and the pedal device can be made smaller.

Also, by applying the second reaction force to the pedal at a position between the arranged position of the first reaction force application device and the operation position, then the accuracy in the pedal operation load can be improved.

More specifically, if the second reaction force is applied to the pedal at a position between the arranged position of the first reaction force application device and the supporting position, then the second reaction force application device becomes larger in size, and the accuracy in its elastic force is lowered. In other words, for example, when the second reaction force application device is formed from a coil spring, and its coil wire is made thicker or the outer coil diameter is made larger, its load accuracy also lowers. As a result, differences would likely occur in the pedal operation load accuracy from one device manufactured to another.

In contrast, by applying the second reaction force at a position between the arranged position of the first reaction force application device and the operation position, the second reaction force application device can be made smaller in size, and lowering of the accuracy in its elastic force can be suppressed. By this, the pedal operation load accuracy for each of the pedal devices manufactured can be improved.

In addition to the effects obtained by the pedal device of an electronic keyboard apparatus of the described embodiments, the pedal device may be equipped with a restriction device that is provided at a position between the arranged position of the first reaction force application device and the operation position of the pedal and restricts a lower limit position of the pedal by restricting rotational movement of the pedal. The second reaction force application device is disposed opposite to the restriction device, and compressed in association with the depression operation of the pedal upon abutting against the restriction device when the amount of depression of the pedal exceeds a specified amount, which is effective in that the amount of depression (the specified amount) of the pedal until the second reaction force is applied to the pedal can be accurately set.

More specifically, the amount of depression (the specified amount) of the pedal until the second reaction force is applied to the pedal, or a so-called backlash, is desired to have a high accuracy when the performer performs while placing his foot on the pedal, or for a depression operation called half-pedaling. Such a backlash is difficult to be influenced by the dimensional accuracy of the second reaction force application device (the dimensional accuracy in the direction in which the pedal is depressed) when the second reaction force application device is provided at a position between the arranged position of the first reaction force application device and the operation position, and the accuracy is higher. On the other hand, the backlash would readily be influenced by the dimensional accuracy of the second reaction force application device when the second reaction force application device is provided at a position between the arranged position of the first reaction force application device and the supporting position, and the accuracy would become lower. For this reason, if the second reaction force application device is provided at a position between the arranged position of the first reaction force application device and the supporting position, differences in the backlash would likely occur in individual devices manufactured.

In contrast, by disposing the second reaction force application device at a position between the arranged position of the first reaction force application device and the operation position, the backlash can be made more difficult to be influenced by the dimensional accuracy of the second reaction force application device, whereby differences in the backlash can be suppressed. By this, backlash can be accurately set for each of the individual apparatuses manufactured.

In further embodiments, the pedal device may be equipped with an actuator that is removably attached to the pedal and has a stopper section disposed opposite to the restriction device in a state of the actuator being attached to the pedal. The second reaction force application device is fitted inside the stopper section. Therefore, the stopper section can be used as a storage space for the second reaction force application device, which is effective in making the device smaller in size. Also, the second reaction force application device is attached to the pedal in one piece with the actuator, such that the second reaction force application device, together with the actuator, can be attached to the pedal. This is effective in improving the workability. Furthermore, even if the pedal is not equipped with the second reaction force application device, the second reaction force application device can be provided thereon by replacing the actuator, and feeling of operation similar to that provided by the damper pedal of an acoustic piano can be realized.

In further embodiments, the pedal device may be equipped with a sensor that detects the amount of depression of the pedal based on the amount of rotational movement of the pedal, and is structured to output an electrical signal to the electronic keyboard apparatus according to a detection result of the sensor, wherein the actuator is equipped with a transmission section that transfers the amount of rotational movement of the pedal to the sensor. Therefore, by suitably changing the shape of the transmission section, the relation between the amount of depression of the pedal and the electrical signal to be outputted to the electronic keyboard apparatus can be arbitrarily set. Accordingly, it is effective in that the electrical signal to be outputted to the electronic keyboard apparatus can be readily interlocked with changes in the operation load of the pedal.

In further embodiments, the pedal device may be equipped with a plurality of pedals, and is equipped with the second reaction force application device for at least one of the plurality of pedals. A pedal whose operation load changes in a stepwise fashion according to the amount of depression and a pedal whose operational load is constant regardless of the amount of depression of the pedal can be co-existed, such that a single device can be provided with the pedals having feelings of operation different from one another.

The described embodiments relate to a pedal device for an electronic keyboard instrument and, in particular to a pedal device of an electronic keyboard instrument that is capable of reducing the size thereof, while realizing a feeling of operation similar to that of the damper pedal of an acoustic piano.

The embodiments of the invention are described with reference to the accompanying drawings. FIG. 1 is an exploded perspective view of a pedal device 1 of an electronic keyboard apparatus in accordance with an embodiment of the invention. It is noted that arrows U-D, L-R and F-B in FIG. 1 indicate an up-down direction, a left-right direction and a front-back direction of the pedal device 1 of the electronic keyboard apparatus, respectively.

First, referring to FIG. 1, a general structure of the pedal device 1 of the electronic keyboard apparatus (hereafter simply referred to as the "pedal device 1") is described. The pedal device 1 is used for an electronic keyboard apparatus, such as, an electronic piano or the like (not shown), and is a device for adding various types of sound effects to musical notes generated by the electronic keyboard apparatus. As shown in FIG. 1, the pedal device 1 is mainly equipped with a chassis 10 composing a main body, and a first pedal 20, a second pedal 30 and a third pedal 40 arranged side by side in the left-right direction of the chassis 10. As the performer depresses and operates each of the pedals 20, 30 and 40, the pedal device 1 outputs a voltage value corresponding to the amount of depression to the electronic keyboard apparatus, and is structured to give sound effects similar to those created by a soft pedal, a sostenuto pedal and a damper pedal of an acoustic piano to musical notes of the electronic keyboard apparatus.

The chassis 10 is composed of an upper chassis 10*a* (also referred to herein as a part of the chassis) and a lower chassis 10*b* (also referred to herein as a part of the chassis) formed from resin material such as ABS resin. The upper chassis 10*a* and the lower chassis 10*b* are parts of the chassis superposed and assembled together into a hollow box shape having an internal space S for mounting a first spring 50, a sensor 60 and a circuit board 70 therein. A connection cable 71 extends from the circuit board 70 for connecting the pedal device 1 to the electronic keyboard apparatus.

The first pedal 20, the second pedal 30 and the third pedal 40 correspond to a soft pedal, a sostenuto pedal and a damper pedal of an acoustic piano, respectively, and are each formed from metal material such as brass, iron steel and the like into an elongated plate shape. Also, the pedals 20, 30 and 40 have rear end sections supported by the chassis 10, and front end sections that are exposed on the front side of the chassis 10. Each of the pedals 20, 30 and 40 may be depressed at the front end section side by the performer, thereby being rotationally moved downwardly about the supporting position as a pivot supported by the chassis 10.

A first spring 50 applies a reaction force countering a depression operation to each of the pedals 20, 30 and 40, and may be composed of a coil-shaped compression spring. Also, the first spring 50 is arranged at each of the pedals 20, 30 and 40, and is retained between the chassis 10 and each of the pedals 20, 30 and 40 in a pre-compressed (pre-pressurized) state. The first spring 50 is compressed in association with depression operation of each of the pedals 20, 30 and 40, and applies a reaction force countering the depression operation (hereafter referred to as a "first reaction force") by its elastic force to each of the pedals 20, 30 and 40.

The sensor 60 detects the amount of depression on each of the pedals 20, 30 and 40, and outputs a resistance value corresponding to the amount of depression, and is structured with a lever section 61 that rotational moves in association with depression operation of each of the pedals 20, 30 and 40, and a variable resistor (not shown) that outputs a resistance value corresponding to the amount of rotational movement of the lever section 61, in other words, the amount of depression of each of the pedals 20, 30 and 40. Also, the sensor 60 is mounted on the circuit board 70, and is arranged at each of three positions corresponding to the arranged positions of the pedals 20, 30 and 40. The sensor 60 outputs a resistance value corresponding to each of the amounts of depression of the respective pedals 20, 30 and 40, and a voltage value corresponding to the resistance value is outputted to the electronic keyboard apparatus through the connection cable 71. As a result, sound effect corresponding to the amount of depression of each of the pedals 20, 30 and 40 is applied to musical notes of the electronic keyboard apparatus.

Figure 2:
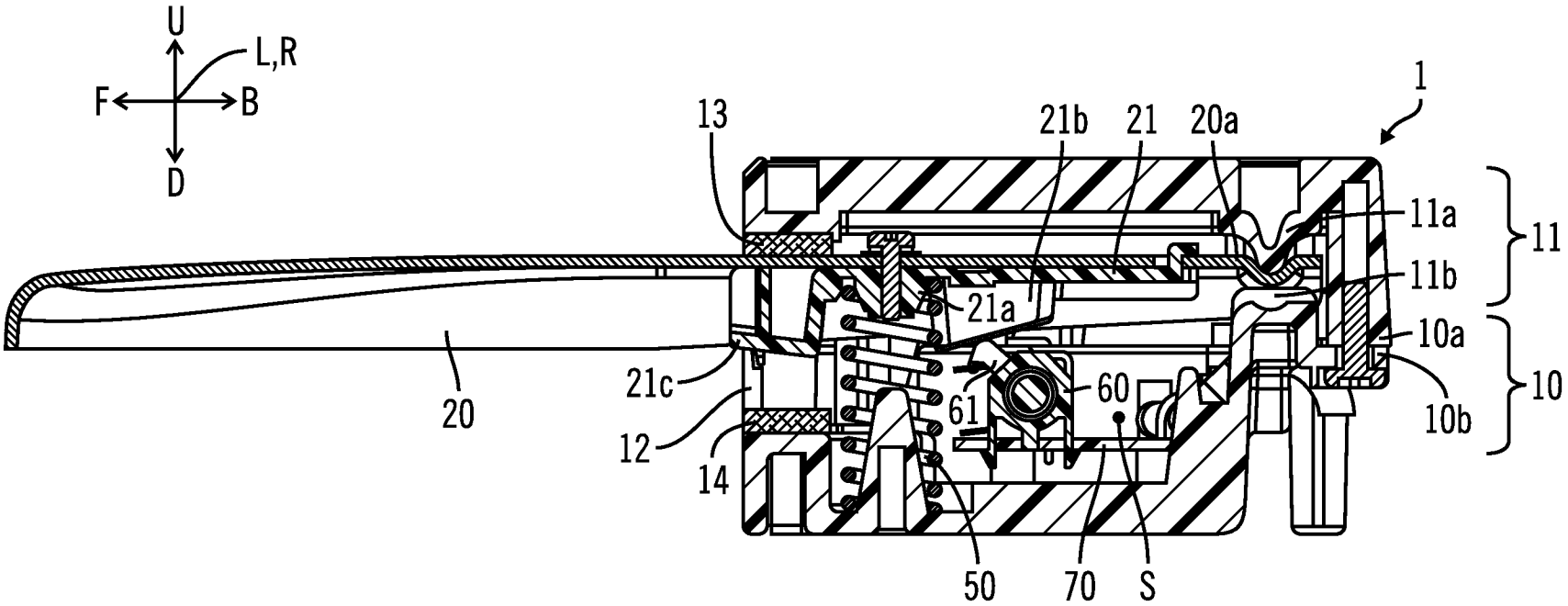
FIG. 2 illustrates a cross-sectional view of the pedal device of an electronic keyboard apparatus taken along a line II-II of FIG. 1.
Figure 3:
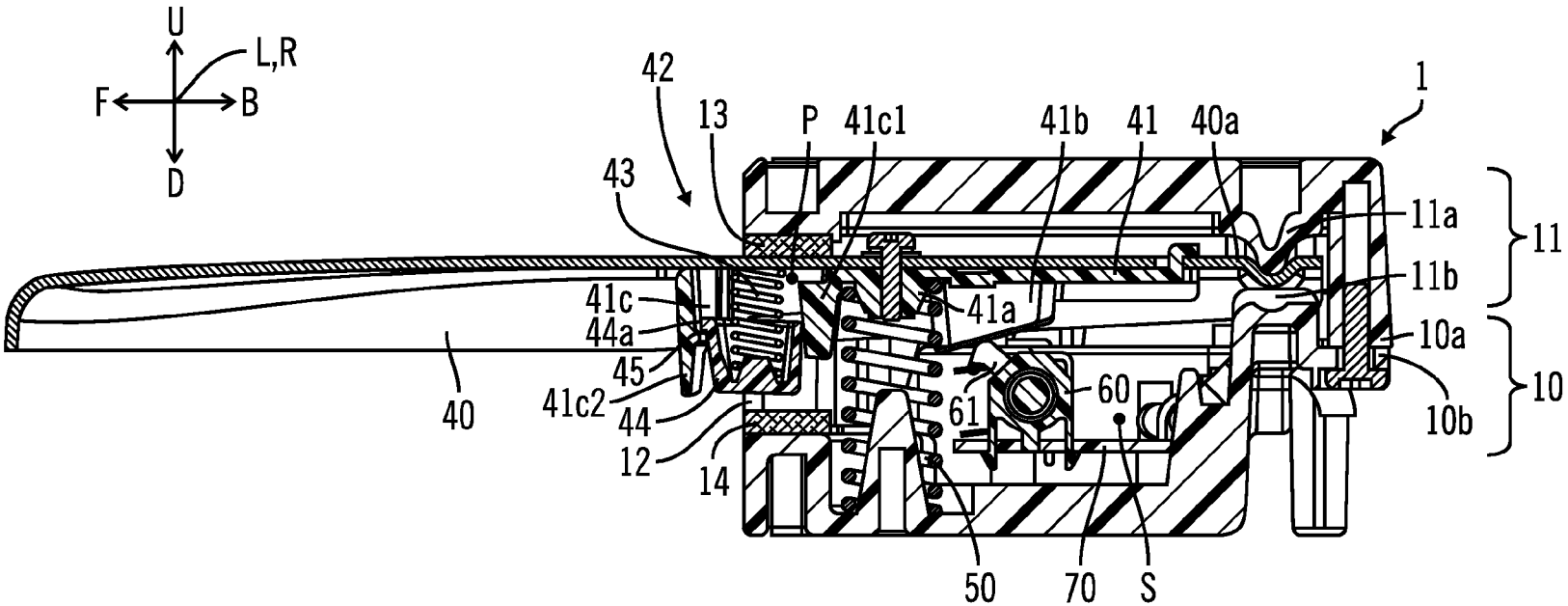
FIG. 3 illustrates a cross-sectional view of the pedal device of an electronic keyboard apparatus taken along a line III-III of FIG. 1.

Next, referring to FIG. 1 through FIG. 4, the detailed structure of each of the components of the pedal device 1 is described. FIG. 2 is a cross-sectional view of the pedal device 1 taken along a line II-II of FIG. 1, and FIG. 3 is a cross-sectional view of the pedal device 1 taken along a line III-III of FIG. 1. FIG. 4 (*a*) is a bottom side perspective view of the first pedal 20, and FIG. 4 (*b*) is a bottom side perspective view of the third pedal 40. It is noted that arrows U-D, L-R and F-B in FIG. 2 and FIG. 3 indicate an up-down direction, a left-right direction and a front-back direction of the pedal device 1, respectively.

As shown in FIG. 1 through FIG. 3, supporting sections 11 are provided on the rear side of the internal space S of the chassis 10 at three locations corresponding to the arranged positions of the first pedal 20, the second pedal 30 and the third pedal 40, respectively. The supporting section 11 is a portion for supporting each of the pedals 20, and 40, and is composed of a convex upper supporting section 11*a* formed on the upper chassis 10*a*, and a lower supporting section 11*b* formed on the lower chassis 10*b*. Each of the pedals 20, 30 and 40 is held at their rear end sections between the upper supporting section 11*a* and the lower supporting section 11*b*, such that the pedals are rotatably supported on the chassis 10 in a cantilever fashion.

Opening sections 12 are provided in the front face of the chassis 10 at three locations corresponding to the arranged positions of the first pedal 20, the second pedal 30 and the third pedal 40, respectively. The opening sections 12 are portions for exposing the front end sections of the pedals 20, 30 and 40 on the front side of the chassis 10, and are each composed of an upper mouth section 12*a* formed in an opening in the upper chassis 10*a* in a generally rectangular shape as viewed in a front view, and a lower mouth section 12*b* formed in an opening in the lower chassis 10*b* in a generally rectangular shape as viewed in a front view. Also, cushions 13 and 14 are attached to an upper face and a lower face of the opening section 12. The cushions 13 and 14 form restriction devices that restrict rotational movements of each of the pedals 20, 30 and 40, and is composed of a shock absorbing material, such as, felt, urethane foam or the like. Each of the pedals 20, 30 and 40 is prevented, upon abutting against the cushion 13 or 14, from further rotational movement, whereby its upper limit position and the lower limit position are set. Also, when each of the pedals 20, 30 and 40 abuts against the cushions 13 and 14, the impact is damped by the cushions 13 and 14. By this, thudding sounds can be suppressed.

Groove sections 20*a*, 30*a* and 40*a* are provided at the rear end sections of the first pedal 20, the second pedal 30 and the third pedal 40 along the width direction (in the arrowed direction L-R), respectively. The groove sections 20*a*, 30*a* and 40*a* are portions that are supported by the supporting portions 11 of the chassis 10, and are each formed as a recess having a generally U-shaped cross section. The pedals 20, 30 and 40 rotationally move about the groove sections 20*a*, 30*a* and 40 as fulcrums, respectively. Also, actuators 21, 31 and 41 are detachably attached to the lower surfaces of the pedals 20, 30 and 40 by screws 15, respectively. The actuators 21, 31 and 41 are provided to transfer the amounts of depression of the respective pedals 20, 30 and 40 to the sensor 60 and regulate the amounts of depression, and are each formed from resin material such as POM resin in an elongated plate shape.

Here, referring to FIGS. 2 and 4, the structure of the actuators 21, 31 and 41 is described in detail. It is noted that the actuator 31 has the same structure as that of the actuator 21, and therefore description of the detailed structure of the actuator 31 is omitted.

Figure 4A:
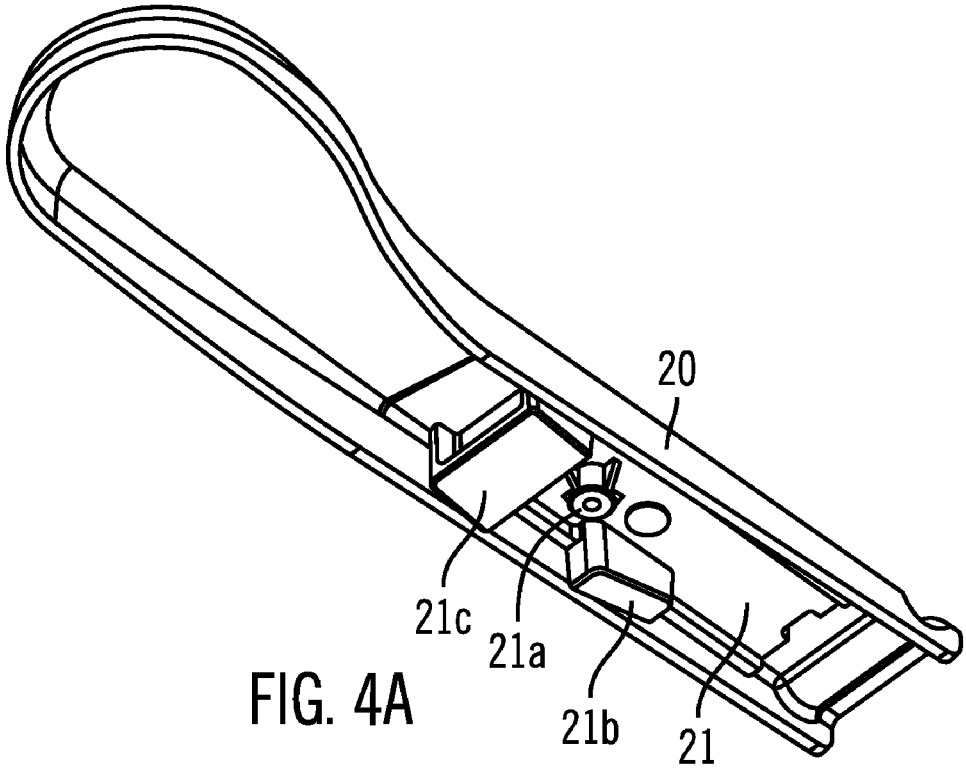
FIG. 4*a* illustrates a bottom side perspective view of a first pedal.

As shown in FIG. 2 and FIG. 4*a*, a retaining section 21*a*, a transmission section 21*b* and a stopper section 21*c* are provided on the bottom face of the actuator 21. The retaining section 21*a* is a portion for retaining the first spring 50, and is provided in a manner to protrude generally in a central section of the actuator 21. A first reaction force by the first spring 50 is applied to the first pedal 20 generally at the central section of the actuator 21 where the retaining section 21*a* is provided.

The transmission section 21*b* is a portion for transferring the amount of depression of the first pedal 20 to the sensor 60, and is provided in a manner to protrude at a position opposite to the level section 61 of the sensor 60. The transmission section 21*b* pushes the lever section 61 of the sensor 60 in association with depression operation of the first pedal 20, thereby transferring the amount of depression of the first pedal 20 to the sensor 60. As a result, a voltage value corresponding to the amount of depression of the first pedal 20 is outputted to the electronic keyboard apparatus.

The stopper section 21*c* is a portion for regulating the amount of depression of the first pedal 20, and is provided in a manner to protrude in the front end section of the actuator 21 at a position opposite to the cushion 14. When the stopper section 21*c* abuts against the cushion 14, downward rotational movement of the first pedal 20 is restricted, and its lower limit position is restricted. By this, the amount of depression of the first pedal 20 is regulated.

Figure 4B:
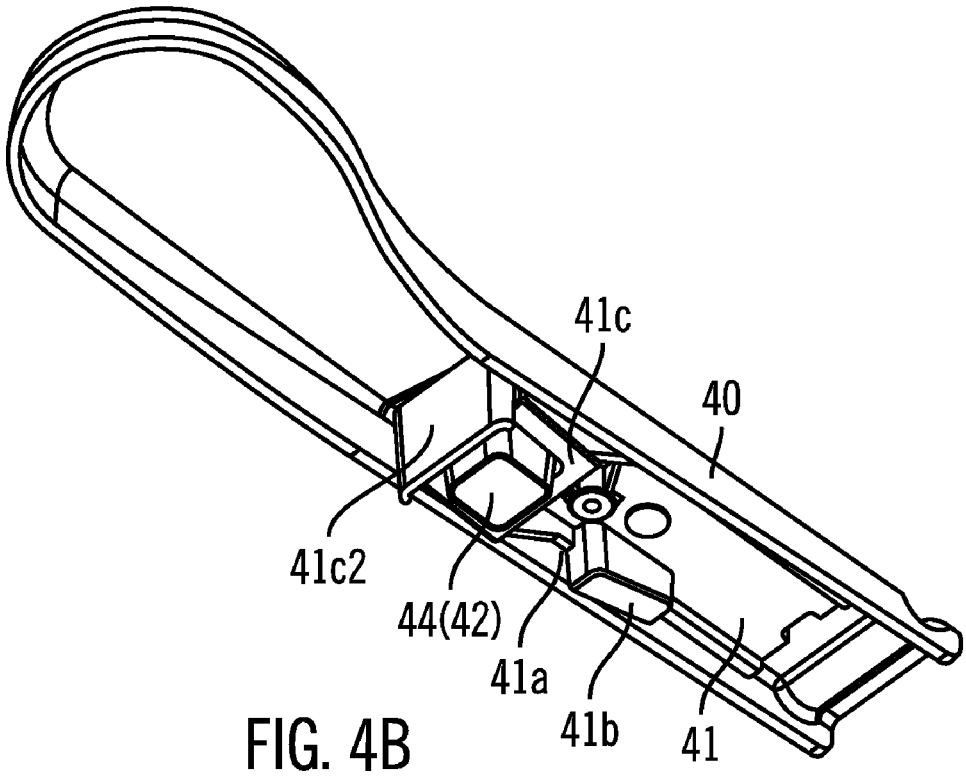
FIG. 4*b* illustrates a bottom side perspective view of a third pedal.

As shown in FIG. 3 and FIG. 4*b*, a retaining section 41*a*, a transmission section 41*b* and a stopper section 41*c* are provided on the bottom face of the actuator 41. The retaining section 41*a* is a portion for retaining the first spring 50, and is provided generally in a central section of the actuator 41. A first reaction force by the first spring 50 is applied to the third pedal 40 generally at the central section of the actuator 41 where the retaining section 41*a* is provided. It is noted that the retaining section 41*a* in accordance with the present embodiment also plays a role of a mounting section for mounting the screw 15. By this, an independent mounting section is not required, and thus the number of components can be reduced, whereby the product cost can be reduced.

The transmission section 41*b* is a portion for transferring the amount of depression of the third pedal 40 to the sensor 60, and is provided in a manner to protrude at a position opposite to the level section 61 of the sensor 60. The transmission section 41*b* pushes the lever section 61 of the sensor 60 in association with depression operation of the third pedal 40, thereby transferring the amount of depression of the third pedal 40 to the sensor 60. As a result, a voltage value corresponding to the amount of depression of the third pedal 40 is outputted to the electronic keyboard apparatus. Accordingly, the relation between the amount of depression of the third pedal 40 and the voltage value outputted to the electronic keyboard apparatus is determined by the shape of the transmission section 41*b*. Therefore, by suitably changing the shape of the transmission section 41*b*, the relation between the amount of depression of the third pedal 40 and the voltage value to be outputted to the electronic keyboard apparatus can be arbitrarily set. By this, the voltage value to be outputted to the electronic keyboard apparatus can be readily interlocked with changes in the operation load of the third pedal 40. The transmission section 41*b* in accordance with the present embodiment is formed as a sloped surface that tilts downwardly toward the rear end section side of the third pedal 40. By this, only by changing the tilt angle of the transmission section 41*b*, the relation between the amount of depression of the third pedal 40 and the voltage value to be outputted to the electronic keyboard apparatus can be readily set.

The stopper section 41*c* is a portion for regulating the amount of depression of the third pedal 40, and is provided in a manner to protrude in the front end section of the actuator 41 at a position opposite to the cushion 14. When the stopper section 41*c* abuts against the cushion 14, downward rotational movement of the third pedal 40 is restricted, and its lower limit position is restricted. By this, the amount of depression of the third pedal 40 is regulated.

Also, the stopper section 41*c* is formed in a hollowed out configuration that has an internal space P for mounting a second reaction force application mechanism 42 (or second reaction force application device) therein, and opens in a central section of the bottom face. The second reaction force application mechanism 42 is provided to change the operation load of the third pedal 40 during the course of pedal-depression, and is composed of a second spring 43 and a movable stopper 44, which is a part of the second reaction force application device 42. The second reaction force application mechanism 42 is mounted inside the internal space P of the stopper section 41*c*, and therefore is attached together with the actuator 41 to the third pedal 40.

The second spring 43 applies a reaction force countering depression operation to the third pedal 40, and may be composed of a coil-shaped compression spring. Also, the second spring 43 is retained between the third pedal 40 and the moveable stopper 44 in a pre-compressed (pre-pressurized) state. When the third pedal 40 is operated and depressed to the extent exceeding a specified amount of depression of the third pedal 40 (hereafter referred to as a "specified amount"), the second spring 43 is compressed in association with depression operation of the third pedal 40, and applies a reaction force countering the depression operation (hereafter referred to as a "second reaction force") by its elastic force to the third pedal 40. The second reaction force is applied by the second spring 43 to the third pedal 40 in the front end section of the actuator 41 where the stopper section 41*c* is disposed.

The moveable stopper 44 retains the second spring 43, and is formed from a resin material such as ABS resin in a hollowed out configuration whose top face is opened. The moveable stopper 44 is normally urged by the second spring 43, thereby protruding from the bottom face of the stopper section 41*c*. When the amount of depression of the third pedal 40 reaches the specified amount, the moveable stopper 44 abuts against the cushion 14, and when the third pedal 40 is further operated and depressed to the extent exceeding the specified amount, the moveable stopper 44 enters the internal space P of the stopper section 41*c* while compressing the second spring 43. Also, when the third pedal 40 is operated and depressed to the extent exceeding the specified amount, the second spring 43 is stored in the moveable stopper 44. In this manner, by forming the moveable stopper 44 in a hollowed out configuration and using the internal space thereof as a space for storing the second spring 43, the second reaction force application mechanism 42 can be made smaller in size, and the pedal device 1 can be made smaller in size.

A flange section 44*a* is provided at an upper edge section of the moveable stopper 44. The flange section 44*a* is a portion for controlling the lower limit position of the moveable stopper 44, and is formed in a manner to protrude in the front-rear and left-right directions. When the flange section 44*a* abuts against the inner bottom face of the stopper section 41*c*, downward movement of the moveable stopper 44 is restricted, whereby its lower limit position is restricted. Also, a cushion 45 composed of a shock absorbing material such as felt, urethane form or the like is attached to the lower surface of the flange section 44*a*. As the flange section 44*a* abuts against the inner bottom face of the stopper section 41*c* through the cushion 45, impacts thereof can be alleviated. By this, thudding sounds can be suppressed.

A guide section 41*c*1 is provided in the internal space P of the stopper section 41*c*. The guide section 41*c*1 is a portion for guiding entry of the moveable stopper 44, and is provided in a manner to extend in the direction of entry thereof. The moveable stopper 44 enters the internal space P of the stopper section 41*c* along the guide section 41*c*1, whereby its entry is guided. By this, rattling of the moveable stopper 44 can be prevented, and the second spring 43 can be accurately compressed.

Also, a cover section 41*c*2 is provided at the front end section of the stopper section 41*c*. The cover section 41*c*2 is a portion for covering the front side of the moveable stopper 44, and is provided in a manner to protrude downwardly. The moveable stopper 44 is covered by the cover section 41*c*2, such that the exterior appearance can be improved, and the moveable stopper 44 can be protected from external factors such as penetration of dusts, insertion of the fingers or the like.

In this manner, the second reaction force application mechanism 42 is fitted in the stopper section 41*c*, and attached to the third pedal 40 in one piece with the actuator 41, such that the second reaction force application mechanism 42 can be effectively arranged, and the pedal device 1 can be made smaller in size. Also, as the second reaction force application mechanism 42 is attached to the third pedal 40 in one piece with the actuator 41, the second reaction force application mechanism 42 together with the actuator 41 can be attached to the third pedal 40, such that the work efficiency can be improved. Furthermore, even if the pedal (the first pedal 20 or the second pedal 30) is not equipped with the second reaction force application mechanism 42, the second reaction force application mechanism 42 may be provided by replacing the actuator 41, whereby a feeling of operation similar to that created by the damper pedal of an acoustic piano can be realized.

Figure 5A:
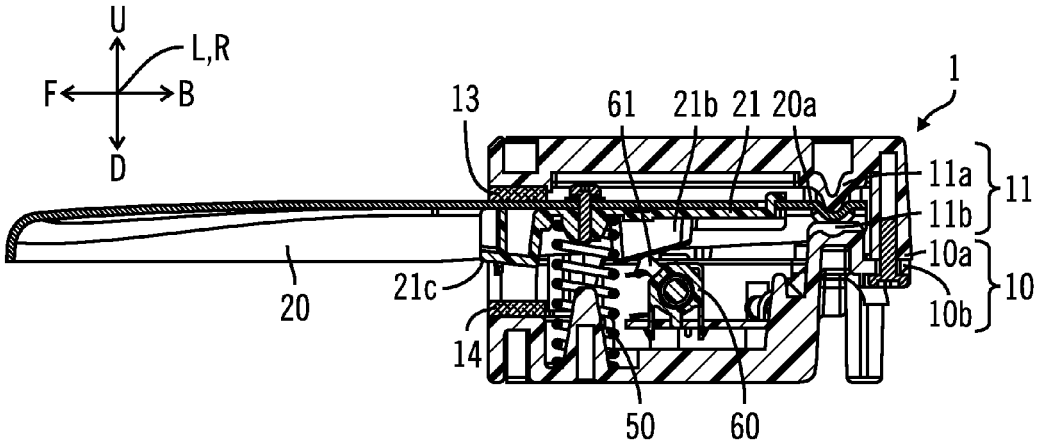
Figure 5B:
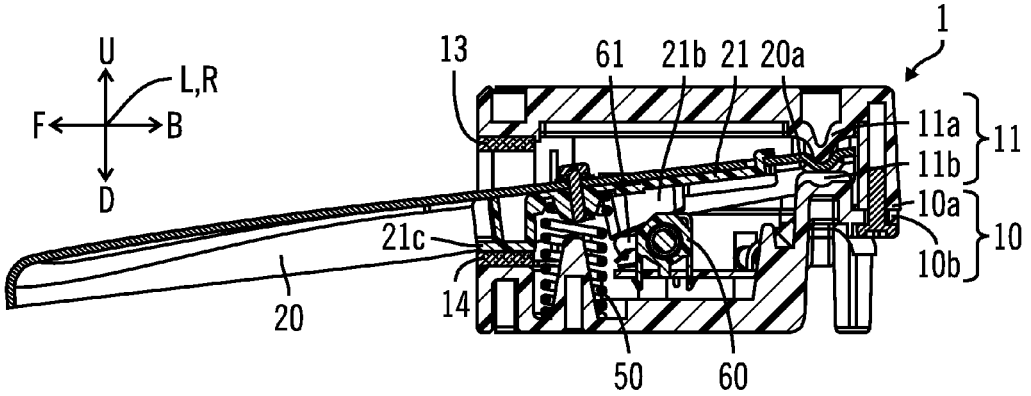
Figure 6A:
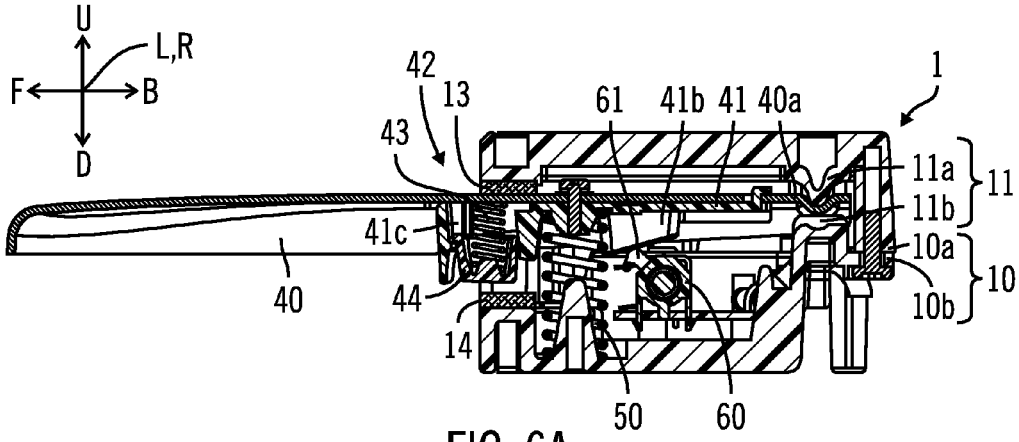
Figure 6B:
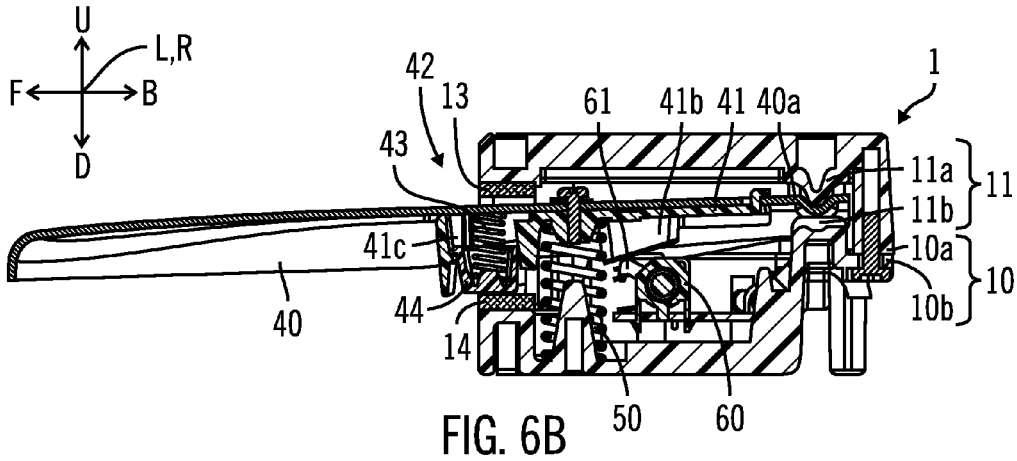
Figure 6C:
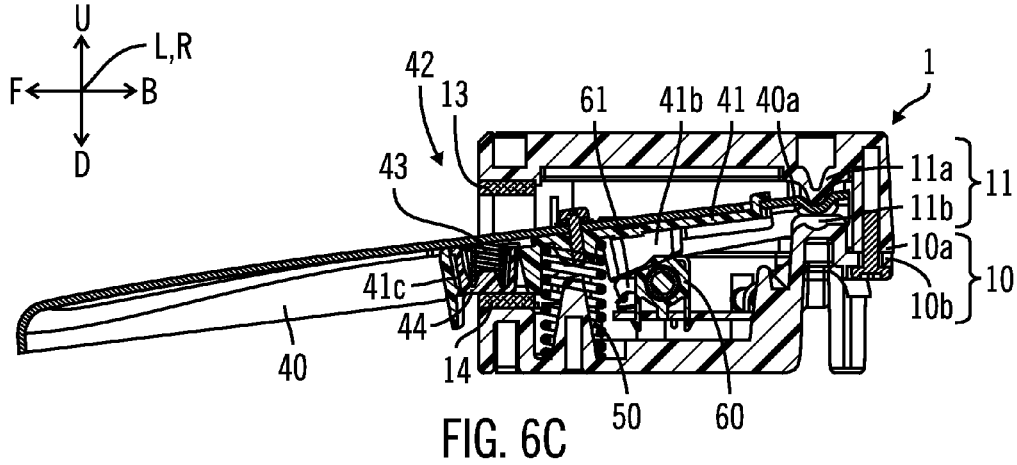

Next, referring to FIGS. 5*a*, 5*b*, 6*a*, 6*b*, and 6*c*, actions of the first pedal 20, the second pedal 30 and the third pedal 40 that take place at the time of depression operation thereof are described. FIGS. 5*a* and 5*b* are cross-sectional views of the pedal device of an electronic keyboard apparatus taken along a line II-II of FIG. 1, wherein FIG. 5*a* shows an initial state of the first pedal and FIG. 5*b* shows a depressed state of the first pedal. Also, FIGS. 6*a*, 6*b*, 6*c* are cross-sectional views of the pedal device of an electronic keyboard apparatus taken along a line III-III of FIG. 1, wherein FIG. 6*a* shows an initial state of the third pedal, FIG. 6*b* shown a specified state of the third pedal, and FIG. 6*c* shows a depressed state of the third pedal. It is noted that, in FIGS. 5*a*, 5*b*, 6*a*, 6*b*, and 6*c*, only those of the components necessary for describing the actions that take place when each of the pedals is depression-operated are appended with reference numerals, and the other components are illustrated without reference numerals.

First, referring to FIGS. 5*a* and 5*b*, actions that take place as the first pedal 20 is depression-operated are described. It is noted that, because the actions that take place upon depression operation of the second pedal 30 are similar to the actions that take place upon depression operation of the first pedal 20, description of the actions that take place upon depression operation of the second pedal 30 is omitted.

When the first pedal 20 is depression-operated from the initial state shown in FIG. 5*a* (in the state in which the first pedal 20 is at the upper limit position), the first pedal 20 rotationally moves downwardly about the groove section 20*a* as a fulcrum supported by the supporting section 11 of the chassis 10. In this case, as the lever section 61 of the sensor 60 is pushed by the transmission section 21*b* of the actuator 21, the amount of depression of the first pedal 20 is detected by the sensor 60. As a result, a voltage value corresponding to the amount of depression of the first pedal 20 is outputted to the electronic keyboard apparatus, whereby a sound effect similar to that of the soft pedal of an acoustic piano is given to musical sounds of the electronic keyboard apparatus. Also, in this case, the first reaction force countering the depression operation is applied by the first spring 50 to the first pedal 20. By this, a feeling of operation similar to that of the soft pedal of an acoustic piano can be given to the performer.

Then, upon reaching the depressed state shown in FIG. 5*b* (in the state in which the first pedal 20 is at the lower limit position), the stopper section 21*c* of the actuator 21 abuts against the cushion 14, whereby rotational downward movement of the first pedal 20 is restricted.

On the other hand, when the depression operation of the first pedal 20 is released from the depressed state shown in FIG. 5*b*, the first pedal 20 rotational moves upwardly about the groove section 20*a* as a fulcrum by the urging force of the first spring 50. Then, returning to the initial state shown in FIG. 5*a*, the first pedal 20 abuts against the cushion 13, and its upward rotational movement is restricted.

Next, referring to FIGS. 6*a*, 6*b*, 6*c*, actions that take place upon depression operation of the third pedal 40 are described. When the third pedal 40 is operated by pedal-depression from the initial state shown in FIG. 6*a* (in the state in which the third pedal 40 is at the upper limit position), the third pedal 40 rotationally moves downwardly about the groove section 40*a* as a fulcrum supported by the supporting section 11 of the chassis 10. In this case, as the lever section 61 of the sensor 60 is pushed by the transmission section 41*b* of the actuator 41, the amount of depression of the third pedal 40 is detected by the sensor 60. As a result, a voltage value corresponding to the amount of depression of the third pedal 40 is outputted to the electronic keyboard apparatus, whereby a sound effect similar to that of the damper pedal of an acoustic piano is given to musical sounds of the electronic keyboard apparatus. Also, in this case, the first reaction force countering the depression operation is applied by the first spring 50 to the third pedal 40.

Then, in the specified state shown in FIG. 6*b* (in the state in which the amount of depression of the third pedal 40 reaches a specified amount), the moveable stopper 44 of the second reaction force application mechanism 42 abuts against the cushion 14. Also, the depression operation on the third pedal 40 is continued after the specified state shown in FIG. 6*b*, the moveable stopper 44 enters the stopper section 41*c* of the actuator 41 while compressing the second spring 43. In this case, in addition to the first reaction force by the first spring 50, the second reaction force countering the depression operation by the second spring 43 is also applied to the third pedal 40, whereby the operation load changes. As a result, a feeling of operation similar to that of the damper pedal of an acoustic piano can be given to the performer.

Then, upon reaching the depressed state shown in FIG. 6*c* (in the state in which the third pedal 40 is at the lower limit position), the stopper section 41*c* of the actuator 41 abuts against the cushion 14, whereby rotational downward movement of the third pedal 40 is restricted.

On the other hand, when the depression operation of the third pedal 40 is released in the depressed state shown in FIG. 6*c*, the third pedal 40 rotationally moves upwardly about the groove section 40*a* as a fulcrum by the urging force of the first spring 50 and the second spring 43. Then, returning to the initial state shown in FIG. 6 (*a*), the third pedal 40 abuts against the cushion 13, and its upward rotational movement is restricted.

Figure 7:
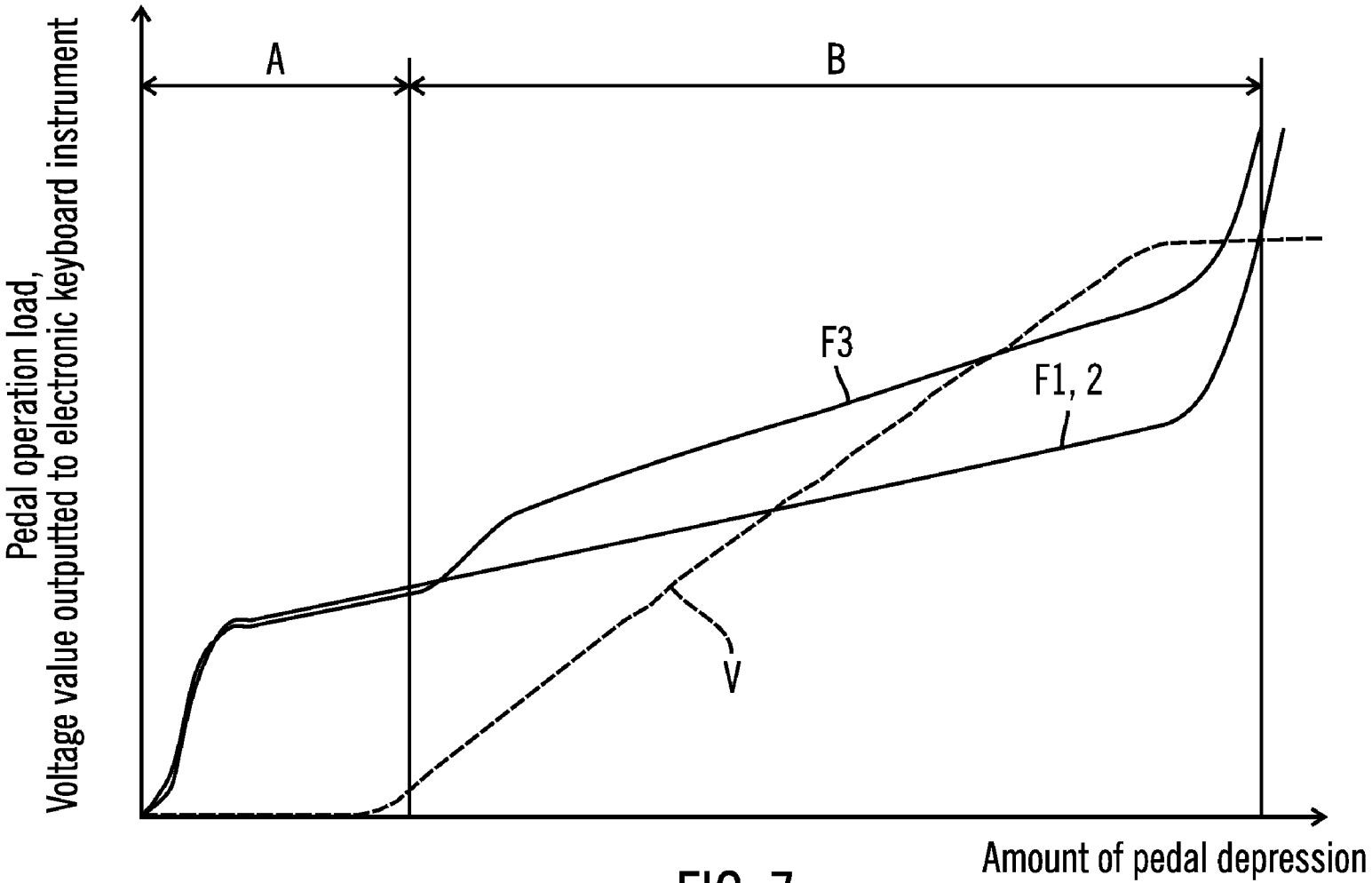
FIG. 7 illustrates a graph showing the relation between the amounts of depression of the first pedal, the second pedal and the third pedal, and their operation loads and voltage values outputted to the electronic keyboard apparatus.

Next, referring to FIG. 7, the relation between the amounts of depression of the first pedal 20, the second pedal 30 and the third pedal 40, and their operation loads and voltage values outputted to the electronic keyboard apparatus are described. FIG. 7 is a graph showing the relation between the amounts of depression of the first pedal 20, the second pedal 30 and the third pedal 40, and their operation loads and voltage values outputted to the electronic keyboard apparatus. It is noted that a solid line F1, 2 in FIG. 7 indicates the relation between the amounts of depression of the first pedal 20 and the second pedal 30 and their operation loads, a solid line F3 indicates the relation between the amount of depression of the third pedal 40 and its operation load, and a broken line V indicates the relation between the amount of depression of each of the pedals 20, 30 and 40 and the voltage value outputted to the electronic keyboard apparatus.

First, the relation between the amounts of depression of the first pedal 20, the second pedal 30 and the third pedal 40 and their operation loads is described. Only the first reaction force by the first spring 50 is applied to the first pedal 20 and the second pedal 30 from the initial state to the depressed state. Therefore, the operation load of each of the pedals 20 and 30 linearly increases with the amount of depression, as indicated by the solid line F1, 2. It is noted that the first spring 50 is pre-compressed (pre-pressurized), such that a reaction force according to the compression amount is applied to each of the pedals 20 and 30 at the start of the depression operation.

In contrast, only the first reaction force by the first spring 50 is applied to the third pedal 40 from the initial state to the specified state (in a range indicated as a period A), and the second reaction force by the second spring 43 in addition to the first reaction force by the first spring 50 are applied to the third pedal 40 from the specified state to the depressed state (in a range indicated as a period B). Therefore the operation load of the third pedal 40 changes during the course of depression, as indicated by the solid line F3. More specifically, the operation load of the third pedal 40 linearly increases with the amount of depression from the initial state to the specified state (in the range indicated as the period A) because only the first reaction force by the first spring 50 is applied.

It is noted that the first spring 50 is pre-compressed (pre-pressurized), such that a reaction force according to the compression amount is applied to the third pedal 40 at the start of the depression operation. Then, upon reaching the specified state, the second reaction force by the second spring 43 in addition to the first reaction force by the first spring 50 are applied to the third pedal 40, such that the operation load of the third pedal 40 linearly changes according to the amount of depression at a greater change rate than that during the period from the initial state to the specified state. In this case, as the second spring 43 is pre-compressed (pre-pressurized), a reaction force according to the compressed amount is applied to the third pedal 40 when it reaches the specified state.

In this manner, the pedal device 1 is provided with the third pedal 40 whose operation load changes in a stepwise fashion according to the amount of depression together with the first pedal 20 and the second pedal 30 whose operation load is constant regardless of the amount of depression, whereby differences are given to the pedal operation feelings.

Next, the relation between the amounts of depression of the first pedal 20, the second pedal 30 and the third pedal 40 and voltage values to be outputted to the electronic keyboard apparatus is described. The voltage value to be outputted to the electronic keyboard apparatus linearly increases with the amount of depression, when the amount of depression exceeds a predetermined amount of depression of each of the pedals 20, 30 and 40, as indicated by the broken line V.

As described above, the pedal device 1 in accordance with the present embodiment is equipped with the first spring 50 that applies the first reaction force countering the depression operation to the third pedal 40, and the second reaction force application mechanism 42 that applies the second reaction force countering the depression operation to the third pedal 40 when the amount of depression of the third pedal 40 exceeds the specified amount, such that the operation load of the third pedal 40 can be changed in a stepwise fashion according to the amount of depression. Accordingly, a feeling of operation similar to that of the damper pedal of an acoustic piano can be realized.

Also, the first spring 50 is provided between the supporting position of the third pedal 40 supported by the chassis 10 and the operation position of the third pedal 40 that is operated through depression by the performer, and applies the first reaction force to the third pedal 40 at a position between the supporting position and the operation position. The second reaction force application mechanism 42 is provided between the first spring 50 and the operation position, and applies the second reaction force to the third pedal 40 at a location between the first spring 50 and the operation position of the third pedal 40. Therefore the position of the second reaction force application mechanism 42 is set farther from the supporting position of the third pedal 40 and closer to the operation position, such that the elastic force necessary for the second reaction force application mechanism 42 can be made smaller. By this, the second reaction force application mechanism 42 can be made smaller in size and the pedal device 1 can be made smaller in size.

Also, as the second reaction force is applied to the third pedal 40 at a position between the disposed position of the first spring 50 and the operation position, the second reaction force application mechanism 42 can be made smaller in size, and lowering of the accuracy in the elastic force can be suppressed. By this, the operation load accuracy of the third pedal 40 can be improved.

Furthermore, according to the pedal device 1 in accordance with the present embodiment, the second reaction force application mechanism 42 is disposed opposite to the cushion 14 that is provided between the first spring 50 and the operation position of the third pedal 40. Upon abutting against the cushion 14 when the depression amount of the third pedal 40 exceeds a specified amount, the second reaction force application mechanism 42 is compressed in association with the depression operation of the third pedal 40. This makes the second reaction force application mechanism 42 more difficult to be influenced by its dimensional accuracy (the dimensional accuracy in the direction of depression operation of the third pedal 40), whereby differences in the amount of depression (the specified amount) of the pedal until the second reaction force is applied to the third pedal 40, in other words, differences in the backlash can be suppressed. By this, the backlash can be accurately set for individual pedal devices 1 manufactured.

Figure 8:
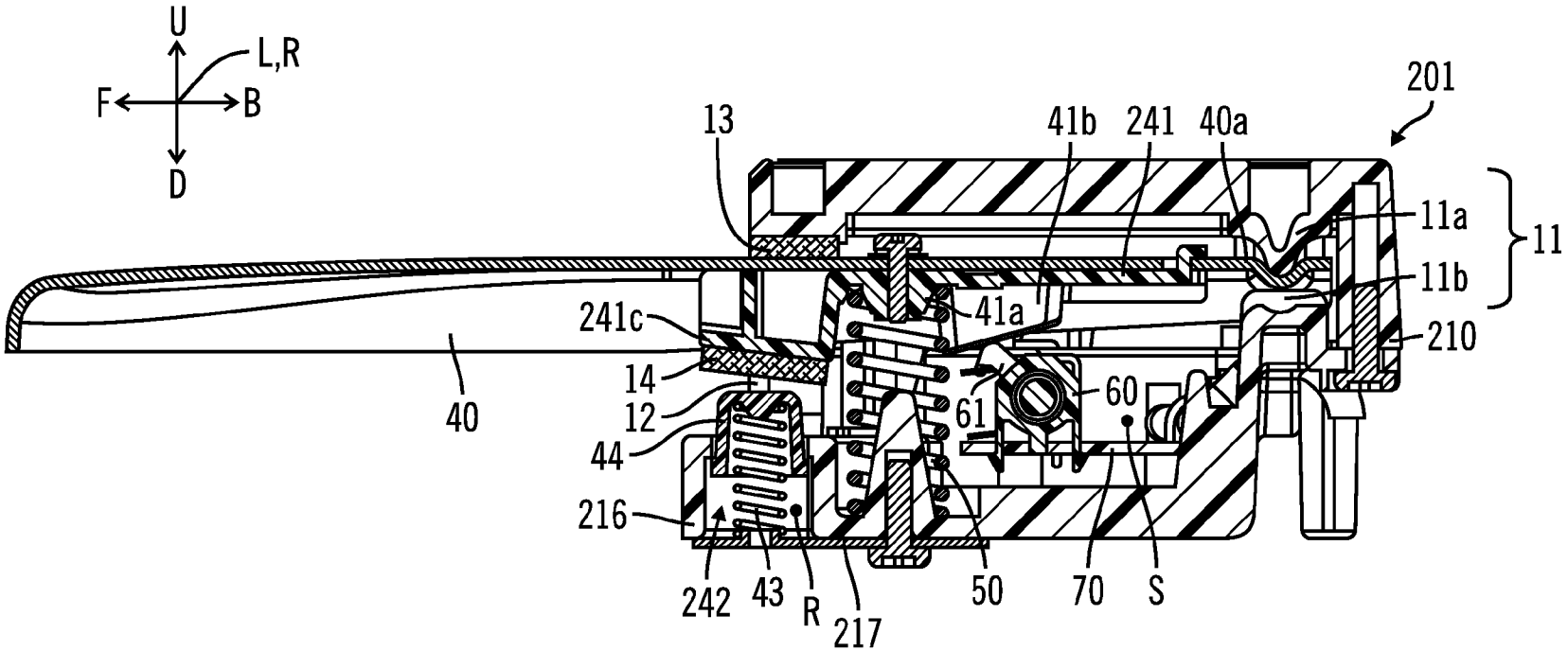
FIG. 8 illustrates a cross-sectional view of a pedal device of an electronic keyboard apparatus in accordance with a second embodiment.

Next, referring to FIG. 8, a pedal device 201 of an electronic keyboard apparatus in accordance with a second embodiment is described. FIG. 8 is a cross-sectional view of the pedal device 201 of an electronic keyboard apparatus in accordance with the second embodiment. It is noted that arrows U-D, L-R and F-B in FIG. 8 indicate an up-down direction, a left-right direction and a front-back direction of the pedal device 201 of the electronic keyboard apparatus, respectively.

In the pedal device 1 of the electronic keyboard apparatus in accordance with the first embodiment, the second reaction force application mechanism 42 is fitted in the stopper section 41*c* of the actuator 41. However, in the pedal device 201 of the electronic keyboard apparatus in accordance with the second embodiment (hereafter simply referred to as the "pedal device 201"), a second reaction force application mechanism 242 (or second reaction force application device) is fitted in a chassis 210. It is noted that the same components as those of the first embodiment are appended with the same reference numbers, and their description is omitted.

As shown in FIG. 8, the pedal device 201 in accordance with the second embodiment has a main body that is formed from a chassis 210. A fitting section 216 is provided below an opening section 12 of the chassis 210. The fitting section 216 is formed in a hollowed out configuration that has an internal space R for fitting a second reaction force application mechanism 242, and an upper face being open at its central section. The second reaction force application mechanism 242 is to change the operation load of the third pedal 40 during the course of depression, and is composed of a second spring 43 and a moveable stopper 44. The second reaction force application mechanism 242 is fitted in the internal space R of the fitting section 216, and retained by a plate 217 that is attached to the lower face of the chassis 210.

The second spring 43 is retained between the plate 217 and the moveable stopper 44 in a pre-compressed (pre-pressurized) state. The moveable stopper 44 is normally urged by the second spring 43, thereby protruding from the upper face of the fitting section 216. When the third pedal 40 is depression-operated to the extent exceeding a specified amount, the moveable stopper 44 enters the internal space R of the fitting section 216 while compressing the second spring 43.

An actuator 241 is attached to the bottom surface of the third pedal 40. The actuator 241 has a stopper section 241*c* whose shape is different from that of the actuator 41 of the first embodiment, and the internal space P is omitted. Also, a cushion 14 is attached to the bottom face of the stopper section 241*c*. The third pedal 40 abuts against the fitting section 216 of the chassis 210 through the cushion 14, whereby its downward rotational movement is restricted, and its lower limit position is restricted. By this, the amount of depression of the third pedal 40 is regulated.

Figure 9:
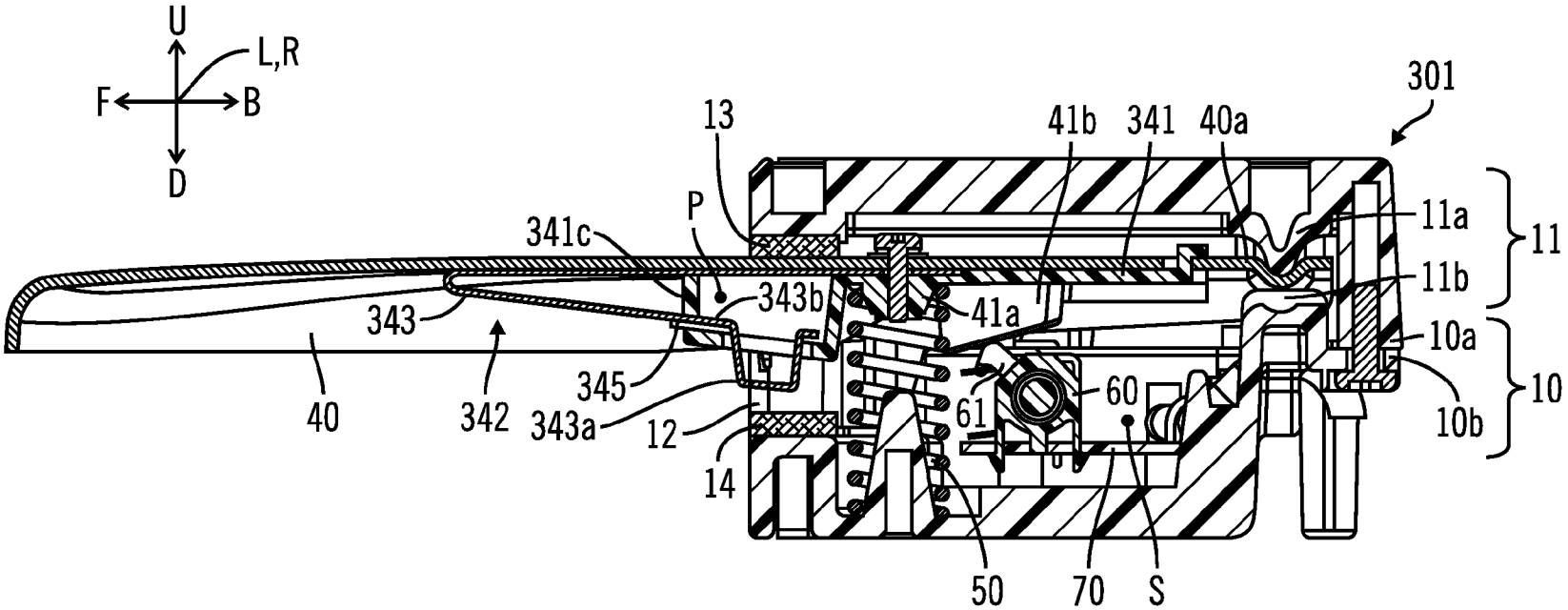
FIG. 9 illustrates a cross-sectional view of a pedal device of an electronic keyboard apparatus in accordance with a third embodiment.

Next, referring to FIG. 9, a pedal device 301 of an electronic keyboard apparatus in accordance with a third embodiment is described. FIG. 9 is a cross-sectional view of the pedal device 301 of an electronic keyboard apparatus in accordance with the third embodiment. It is noted that arrows U-D, L-R and F-B in FIG. 9 indicate an up-down direction, a left-right direction and a front-back direction of the pedal device 301 of the electronic keyboard apparatus, respectively.

In the pedal device 1 of the electronic keyboard apparatus in accordance with the first embodiment, the second reaction force application mechanism 42 is composed of the second spring 43 and the moveable stopper 44. However, in the pedal device 301 of the electronic keyboard apparatus in accordance with the third embodiment (hereafter simply referred to as the "pedal device 301"), a second reaction force application mechanism 342 (or second reaction force application device) is composed of a second spring 343 (or a part of the second reaction force application device). It is noted that the same components as those of the first embodiment are appended with the same reference numbers, and their description is omitted.

As shown in FIG. 9, the pedal device 301 in accordance with the third embodiment has an actuator 341 that is attached to the bottom surface of the third pedal 40. The actuator 341 has a stopper section 341*c* whose shape is different from that of the actuator 41 of the first embodiment. More specifically, the stopper section 341*c* is formed in a hollowed out configuration that has an internal space P for fitting the second reaction force application mechanism 342 and is opened at its front and bottom faces. The second reaction force application mechanism 342 is to change the operation load of the third pedal 40 during the course of depression, and is composed of the second spring 343. This second reaction force application mechanism 342 is fitted in the internal space P of the stopper section 341*c*, thereby being attached to the third pedal 40 in one piece with the actuator 341.

The second spring 343 applies a reaction force countering the depression operation to the third pedal 40, is composed of a leaf spring formed by bending a metal plate material such as a stainless steel plate, and is retained between the third pedal 40 and the stopper section 341*c* of the actuator 341 in a pre-compressed (a pre-pressurized) state. The second spring 343 is compressed in association with the depression operation of the third pedal 40 when the third pedal 40 is depression-operated to the extent exceeding a specified amount, thereby applying a second reaction force countering the depression operation to the third pedal 40.

The second spring 343 is provided with a convex section 343*a*. The convex section 343*a* is a portion that abuts against the cushion 14 when the third pedal 40 is depression-operated to the extent exceeding the specified amount, and is formed in a downwardly protruding convex shape. The convex section 343*a* normally protrudes from the bottom face of the stopper section 341*c*, abuts against the cushion 14 when the amount of depression of the third pedal 40 reaches the specified amount, and enters the internal space P of the stopper section 341*c* while compressing the second spring 343 when the third pedal 40 is depression-operated to the extent exceeding the specified amount of the third pedal 40.

Also, the second spring 343 is provided with a restriction section 343*b* for restricting the lower limit position of the second spring 343. When the restriction section 343*b* abuts against the inner bottom face of the stopper section 341*c*, downward movement of the second spring 343 is restricted, whereby its lower limit position is controlled. A cushion 345 composed of shock absorbing material, such as, felt, urethane form or the like is attached to the bottom face of the restriction section 343*b*. The restriction section 343*b* abuts against the inner bottom face of the stopper section 341*c* through the cushion 345, whereby the impact of the second spring 343 is alleviated. By this, thudding sounds can be suppressed.

As described above, in the pedal device 301 in accordance with the present embodiment, the second reaction force application mechanism 342 is composed only of the second spring 343, such that the number of components can be reduced, and the pedal device 301 can be made smaller in size.

The invention has been described above based on some embodiments, but the invention is not at all limited to the described embodiments, and it is readily presumed that various kinds of modifications can be made within the range that does not depart from the subject matter of the invention.

The materials and configurations recited in the embodiments described above are examples, and other materials and configurations can be used. For example, in the embodiments described above, examples in which the first pedal 20, the second pedal 30 and the third pedal 40 are each formed from a metal material such as brass, iron steel and the like into an elongated plate shape are described. However, without any particular limitation to the above, other kinds of metal material such as stainless steel or the like can be formed into an elongated plate shape, or resin material such as ABS resin, POM resin or the like may be formed into an elongated plate shape.

In the embodiments described above, examples in which the pedal devices 1, 201 and 301 are each formed with three pedals, i.e., the first pedal 20, the second pedal 30 and the third pedal 40 are described. However, without any particular limitation to the above, for example, they may each be formed only from the third pedal 40, or may be formed from two pedals, for example, the first pedal 20 or the second pedal 30 and the third pedal 40, or may be formed from four or more pedals including the third pedal 40.

The embodiments above are described as to examples in which the first pedal 20 and the second pedal 30 correspond to the soft pedal and the sostenuto pedal of an acoustic piano, respectively, and are structured to give sound effects similar to those of the soft pedal and the sostenuto pedal to musical sounds of an electronic keyboard apparatus. However, without any particular limitation to the above, they can be structured to give other sound effects different from those of the soft pedal and the sostenuto pedal to musical sounds of the electronic keyboard apparatus.

In the embodiments described above, the description is made as to examples in which the second spring 43 that applies the second reaction force to the third pedal 40 is formed from a coil-shaped compression spring, and the second spring 343 is formed from a leaf spring. However, without any particular limitation to the above, it is possible that other elastic material that is capable of applying the second reaction force to the third pedal 40 can be used to form the second spring 43 and 343. As the other elastic material, for example, an elastic member composed of rubber elastic material, resin material or the like may be exemplified.

What is claimed is:

1. A pedal device used by a performer of an electronic keyboard apparatus, comprising:

a pedal that is moved in response to a depression operation from the performer;

a chassis that rotationally supports the pedal according to the depression operation to move the pedal downwardly about a supporting position supported by the chassis;

a first reaction force application device that applies a first reaction force countering the depression operation of the pedal to the pedal;

a second reaction force application device that is pre-compressed in a state during a first period of pedal depression from an initial state of no pedal depression until the amount of depression of the pedal reaches a specified amount, and is compressed in association with the depression operation of the pedal when the amount of depression of the pedal exceeds the specified amount during a second period, wherein the second reaction force application device applies a second reaction force with an elastic force countering the depression operation to the pedal;

a restriction device located at a position between a position of the first reaction force application device and the operation position, wherein the restriction device restricts a lower limit position of the pedal by restricting rotational movement of the pedal, wherein the first reaction force application device is located between the supporting position of the pedal and the operation position, and wherein the first reaction force application device applies the first reaction force to the pedal at a position between the supporting position and the operation position, and wherein the second reaction force application device is located between a position of the first reaction force application device and the operation position, and is disposed opposite to the restriction device, and abuts against the restriction device when the amount of depression of the pedal exceeds the specified amount, wherein the second reaction force application device applies the second reaction force to the pedal at a position between a position of the first reaction force application device and the operation position, and wherein the second reaction force application device is compressed in association with the depression operation of the pedal.

2. The pedal device of claim 1, further comprising:

an actuator that is removably attached to the pedal and has a stopper section disposed opposite to the restriction device in a state of the actuator being attached to the pedal, wherein the second reaction force application device is fitted inside the stopper section, and attached to the pedal in one piece with the actuator.

3. The pedal device of claim 2, further comprising:

a sensor that detects the amount of depression of the pedal based on the amount of rotational movement of the pedal, and is structured to output an electrical signal to the electronic keyboard apparatus according to a detection result of the sensor, wherein the actuator is equipped with a transmission section that transfers the amount of rotational movement of the pedal to the sensor.

4. The pedal device of claim 1, father comprising:

a plurality of the pedals, wherein at least one of the plurality of the pedals is equipped with the second reaction force application device.

5. A pedal device for an electronic keyboard apparatus to add sound effects to musical notes generated by the electronic keyboard apparatus in response to an operator depressing the pedal device, comprising:

a first reaction force application device that is configured to apply a first reaction force countering a depression of the pedal by the operator from an initial state to a specified state, wherein the first reaction force increases as the pedal is depressed from the initial state to the specified state; and a second reaction force application device that is pre-compressed in a state against a portion of the pedal during a first period when the pedal is depressed from the initial state to the specified state and that applies a second reaction force countering a depression of the pedal by the operator during a second period after the specified state, wherein after the specified state the first reaction force and the second reaction force are applied to the pedal.

6. The pedal device of claim 5, wherein an operation load of the pedal linearly increases at a first change rate with an amount of the depression of the pedal from the initial state to the specified state when only the first reaction force is applied, and wherein after the specified state, the operation load of the pedal linearly changes at a second change rate according to the amount of depression of the pedal after the specified state, wherein the second change rate is greater than the first change rate.

7. The pedal device of claim 5, wherein the second reaction force application device is located between the first reaction force application device and an operation position where the pedal is depressed by the operator.

8. The pedal device of claim 5, further comprising:

a movable stopper coupled to the pedal, wherein a stopper section is formed between the pedal and the movable stopper, wherein the second reaction force application device is fitted in the stopper section, wherein the second reaction force application device is regulated by a lower limit position of the stopper section reached when the pedal is depressed to the specified state, and wherein the second reaction force application device applies the second reaction force when the pedal is depressed after the stopper section reaches the lower limit position.

9. The pedal device of claim 8, further comprising:

a restriction device, wherein when the movable stopper abuts the restriction device, a downward rotational movement and lower position of the pedal is restricted, and wherein the movable stopper enters an internal space of the stopper section to compress the second reaction force application device to produce the second reaction force when the pedal is depressed by the operator after the specified state.

10. The pedal device of claim 5, further comprising:

a sensor; and an actuator for transferring an amount of the depression of the pedal to the sensor to produce a voltage, wherein the actuator receives the first reaction force from the first reaction force application device at a first location on the actuator and the second reaction force from the second reaction force application device at a second location on the actuator.

11. The pedal device of claim 10, wherein the actuator includes a hollow stopper section in which the second reaction force application device is mounted, and wherein the actuator is attached to the pedal.

12. The pedal device of claim 10, further comprising:

a chassis having a first internal space in which the first reaction force application device is mounted and a fitting section having a second internal space in which the second reaction force application device is mounted, wherein the first and second reaction force application devices are mounted between the chassis and the actuator, and wherein the fitting section abuts against the actuator to restrict a downward movement of the pedal after the specified state.

13. The pedal device of claim 10, further comprising:

a restriction device; and a stopper section formed in the actuator, wherein the second reaction force application device is disposed in the stopper section and has a protruding section extending through a bottom of the stopper section, wherein the protruding section abuts the restriction device when the pedal is depressed to the specified state, wherein the protruding section enters the stopper section when the pedal is depressed following the specified state, and wherein the stopper section abuts against the restriction device to restrict the downward movement of the pedal after the specified state.

14. A pedal device for an electronic keyboard apparatus to add sound effects to musical notes generated by the electronic keyboard apparatus in response to an operator depressing the pedal device, comprising:

a first pedal comprising:

a first reaction force application device that is configured to apply a first reaction force countering a depression of the pedal by the operator from a first initial state to a first specified state, wherein the first reaction force increases as the pedal is depressed from the first initial state to the first specified state; and a second reaction force application device that is configured to apply a second reaction force countering a depression of the pedal by the operator after the first specified state, wherein after the first specified state, the first reaction force and the second reaction force are applied to the pedal; and a second pedal having a third reaction force application device that is configured to apply a third reaction force countering a depression of the second pedal by the operator from a second initial state to a second specified state to produce a third reaction force, wherein the third reaction force increases as the second pedal is depressed from the second initial state to the second specified state, wherein the depression of the first pedal produces a voltage that increases linearly at a first change rate with the amount of depression from the first initial state to the first specified state and increases linearly at a second change rate with the amount of depression from the first specified state, wherein the second change rate is greater than the first change rate, and wherein the second pedal produces a voltage that increases linearly with the amount of depression before and after the second specified state at a third change rate.

15. The pedal device of claim 14, wherein the first pedal provides sound effects to simulate a damper pedal of an acoustic piano and wherein the second pedal provides sound effects to simulate one of a soft pedal and a sostenuto pedal of the acoustic piano.

16. A pedal device for an electronic keyboard apparatus to add sound effects to musical notes generated by the electronic keyboard apparatus in response to an operator depressing the pedal device, comprising:

a pedal;

a chassis having an opening through which the pedal is disposed, wherein the opening provides an upper limit position and a lower limit position to restrict rotational movements of the pedal;

a first reaction force application device mounted in an internal space of the chassis, wherein the first reaction force application device applies a first reaction force countering a depression of the pedal by the operator; and a second reaction force application device that is pre-compressed in a state against a portion of the pedal during a first period when the pedal is depressed from an initial state to a specified state, wherein a second reaction force countering a depression of the pedal by the operator in combination with the first reaction force is applied during a second period after the specified state, and wherein the second reaction force is applied after the pedal is operated to exceed a specified amount of depression.

17. The pedal device of claim 16, wherein the first reaction force device comprises a first spring and wherein the second reaction force device comprises a second spring, wherein the first and second springs apply the first and second reaction forces to the pedal.

* * * * *